United States Patent [19]

Hutcheson

[11] Patent Number: 5,054,724

[45] Date of Patent: Oct. 8, 1991

[54] CONTAINER FOR SUPPORTING A LIMP PLASTIC BAG IN AN UPRIGHT, FOUR CORNERED CONFIGURATION

[76] Inventor: Mabel C. Hutcheson, 914 Granada Blvd. S., Jacksonville, Fla. 32207

[21] Appl. No.: 572,487

[22] Filed: Aug. 27, 1990

[51] Int. Cl.[5] ..... B65B 67/00

[52] U.S. Cl. ..... 248/97; 220/404; 248/100

[58] Field of Search ..... 248/95, 97, 98, 99, 248/100; 220/404

[56] References Cited

U.S. PATENT DOCUMENTS

| | | | |
|---|---|---|---|
| 917,820 | 4/1909 | West | 248/100 X |
| 1,403,751 | 1/1922 | Edstrom | 248/97 |
| 4,418,835 | 12/1983 | Watts | 220/204 |
| 4,467,989 | 8/1984 | Stroh | 248/97 |
| 4,498,652 | 2/1985 | Malik | 248/99 |
| 4,535,911 | 8/1985 | Goulter | 220/404 |
| 4,558,800 | 12/1985 | Isgar | 220/403 |
| 4,664,347 | 5/1987 | Brown | 248/97 |
| 4,735,340 | 4/1988 | Preston | 220/404 |
| 4,792,171 | 12/1988 | Lamy | 248/95 X |
| 4,802,647 | 2/1989 | Celmayster | 248/544 |
| 4,805,857 | 2/1989 | Travis | 248/97 |
| 4,860,982 | 8/1989 | Berlant | 248/100 |
| 4,867,339 | 9/1989 | Hahn | 220/404 |
| 4,907,710 | 3/1990 | Bulkens | 220/404 X |
| 4,938,380 | 7/1990 | Donahoe | 220/404 |

FOREIGN PATENT DOCUMENTS

| | | | |
|---|---|---|---|
| 88/05415 | 7/1988 | PCT Int'l Appl. | 248/97 |

*Primary Examiner*—David L. Talbott

[57] ABSTRACT

A container for holding, in an upright, four cornered configuration, a folded plastic bag having upwardly extending and pleated handles; with a bag being held undistorted and fully opened by horizontal support members that are inserted into the internal pleats of a bag's handles.

8 Claims, 2 Drawing Sheets fig. 4
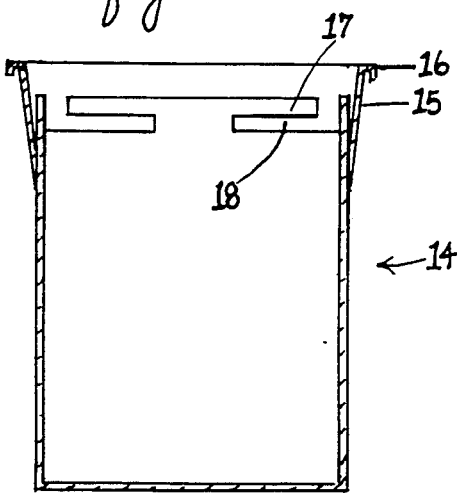
fig. 5
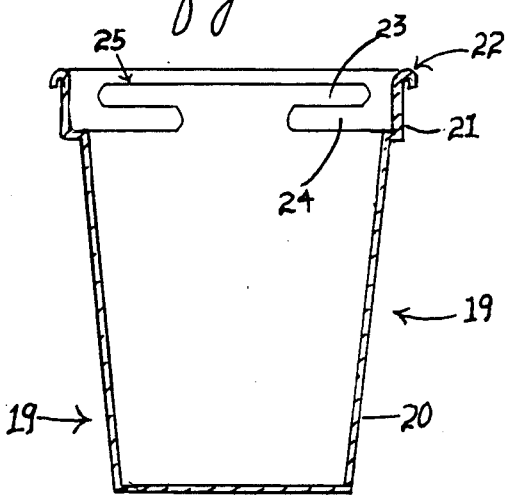
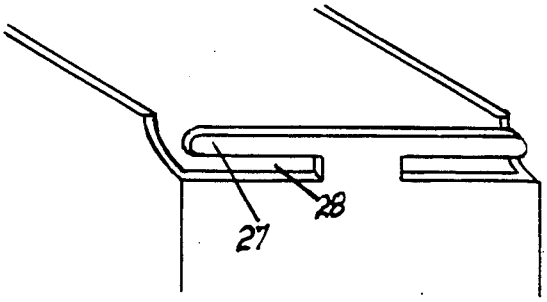
fig. 6
26
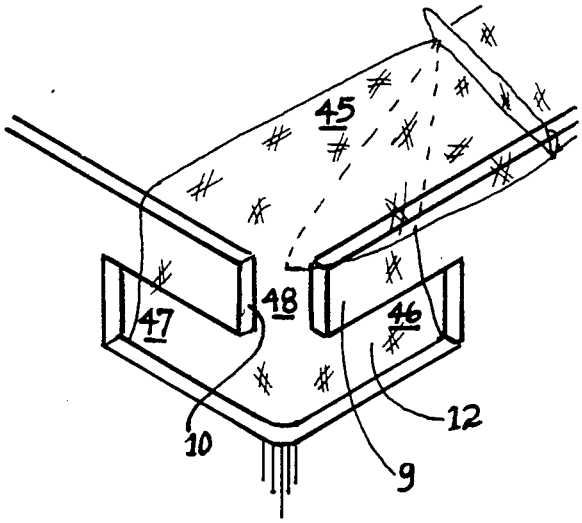
fig. 7

CONTAINER FOR SUPPORTING A LIMP PLASTIC BAG IN AN UPRIGHT, FOUR CORNERED CONFIGURATION

BACKGROUND OF THE INVENTION

1. Field of the Invention

The present invention relates generally to a container for holding household and commercial trash, refuse or supplies and more particularly to a container that is lined with a removable, disposable, plastic bag with upward extending folded handles, a bag of the type used by stores for bagging groceries and merchandise.

2. Description of Prior Art

Most grocery stores and many retail merchants package their products in thin and limp plastic bags that have folds on the sides and cut out, upwardly extending handles. The bags are waterproof, easy to carry, and best of all free. However, the bags have not gained acceptance as trash liners because the plastic material is too limp to hold its shape or maintain an upright position within a container, and the bags are too short to fold over the rim of most trash containers.

Previous inventions have attempted to solve this dilemma with various brackets, clamps, and vertically extending projects and notches. Some of these prior inventions have succeeded in keeping a bag in an upright position, but not in maintaining the undistorted, fully opened cornered configuration of a pre-folded bag.

For the most part these inventions wrap or stretch a bag's handles around a projection that extends through a bag handle's openings, limiting a bag's mouth configuration and the configuration of an open bag to the width of the handle openings.

SUMMARY OF THE INVENTION

It is the general object of this invention to provide a container for a plastic bag having upwardly extending and pleated handles. Said container holding a bag in a fully opened, four cornered configuration, while supporting, on the sides and bottom, a plastic bag in an upright position.

In accordance with the present invention, a preferred embodiment of said container comprises a substantially horizontal planar surface forming the bottom of said container, and a plurality of substantially vertical planar surfaces having an upper rim and forming the side walls of said container. A plurality of pairs of support members are positioned one pair connected to said vertical planar wall and integrally formed with said respective side wall. Each support member has a horizontally extending oppositely from its paired support member, and pointing toward the nearest vertical corner location. Each pair of horizontal support members is generally parallel to and in alignment with the plane of the side wall upon which said pair of support members is mounted. Each support member is capable of insertion, through a respective bag neck or handle opening, into an inner pleat of a bag handle at a location where an outside fold of a plastic bag makes the transition from an open 90° angled configuration of a four cornered fully opened bag to a 0° angled and closed configuration of a folded plastic bag handle near the top seam. All of said support members are generally equal to one another in height. Directly below and adjacent to each support member is an opening. Each said opening is adjacent to a respective vertical corner location. Each said pair of support members has a horizontal measurement, from tip to tip, that is equal to the distance between two top vertical corner locations of the side wall upon which said support members are mounted less a measurement ranging from 1 millimeter to 40 millimeters. The vertical measurement from an upper edge of said support member to said container bottom, is equal to a plastic bag's vertical measurement in fully opened four cornered configuration. The vertical measurement form an upper edge of said support member to a lower edge of said support member is small enough to insert through a respective bag opening, into an inner pleat, and large enough to sustain said support member's horizontal projection. Each opening adjacent said support member has a minimum horizontal measurement equal to approximately 66% of the measurement of a bag's top, handle seam. The maximum horizontal measurement of said opening is approximately 45% of the horizontal measurement of said side wall within which said opening is located. The minimum vertical measurement of said opening is approximately one millimeter and the maximum vertical measurement of said opening is the distance between said support member and said container bottom.

It is an object of this invention to provide a container that is sized to fit a plastic bag of a specific size, and to provide easy insertion and removal of a plastic bag from said container.

It is an object of this invention to provide a container having an upper rim and support members that are rounded as is necessary to inhibit puncture of a plastic bag mounted thereon.

It is a further object of this invention to provide a container having support members that are recessed below and within the confines of an upwardly and outwardly projecting extension of said side walls.

Another object of this invention is to provide a container having tapered walls, enabling said container to be nested or stacked one within another.

Another object of this invention is to provide a container having side walls joined at a vertical corner location.

The foregoing as well as other features and advantages of the invention will be apparent from the following description of the preferred embodiments as illustrated by the accompanying drawings, wherein like reference characters refer to the same parts throughout the various views. The drawings are not necessarily to scale, emphasis instead being placed upon illustrating the principles of the invention.

BRIEF DESCRIPTION OF THE DRAWINGS

FIG. 4 is a side cross sectional view of a second embodiment of the container of this invention;

FIG. 5 is a side cross sectional view of a third embodiment of the container of this invention;

FIG. 6 is a perspective view of one end of a fourth embodiment of the container of this invention; and FIG. 7 is an enlargement of a perspective view of an upper corner of a container, according to the invention, shown supporting a plastic grocery bag.

DESCRIPTION OF THE PREFERRED EMBODIMENT

Figure 2:
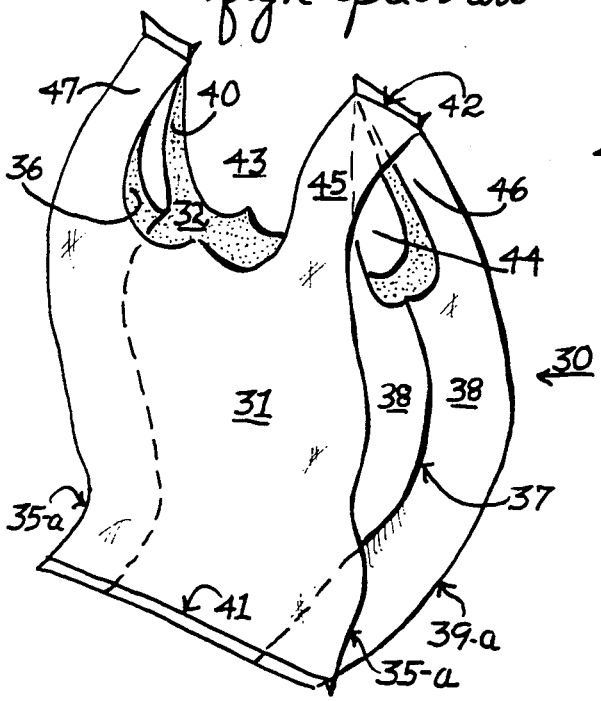
fig 2 prior art
FIG. 2 is a perspective view of a partially opened, prior art, plastic bag of the type used with the present invention.
Figure 3:
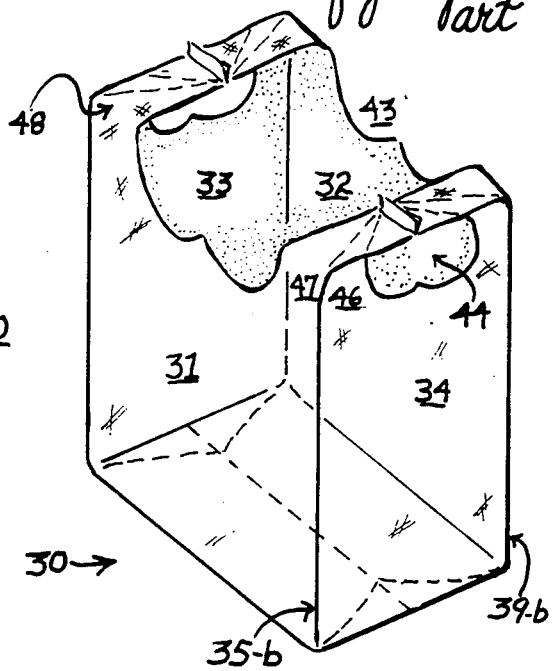
fig 3 prior art
FIG. 3 is a perspective view of the, prior art, plastic bag of FIG. 2 in the fully opened, four cornered configuration that will be maintained by insertion thereof in the container of the present invention.

Referring to FIGS. 2 and 3, prior art, a plastic bag 30 of a known type, that is used with this invention 1 consists of a tubular piece of plastic that has been folded three times on each of two sides, forming a bag front 31, a bag back 32, a left side 33, and a right side 34. Each of these two sides has a front outside fold 35*a* that forms a front inside pleat 36, and inside center fold 37 that makes an outside pleat 38, and a back outside fold 39*a* that forms a back inside pleat 40. The bag, along with these pleats and folds is secured by a fused bottom seam 41 and a fused top seam 42. A "U" shaped opening that includes the upper portion on both inside center folds 37 is cut into the top of the bag, creating two open notches that form the mouth 43 of the bag, and creating two closed notches 44 that are part of the bag's handles 45. In a fully open configuration the front folds 35*a* become the front corners 35*b* of a bag, and the back folds 39*a* become the back corners 39*b*, and the center fold 37 is flattened out.

Figure 1:
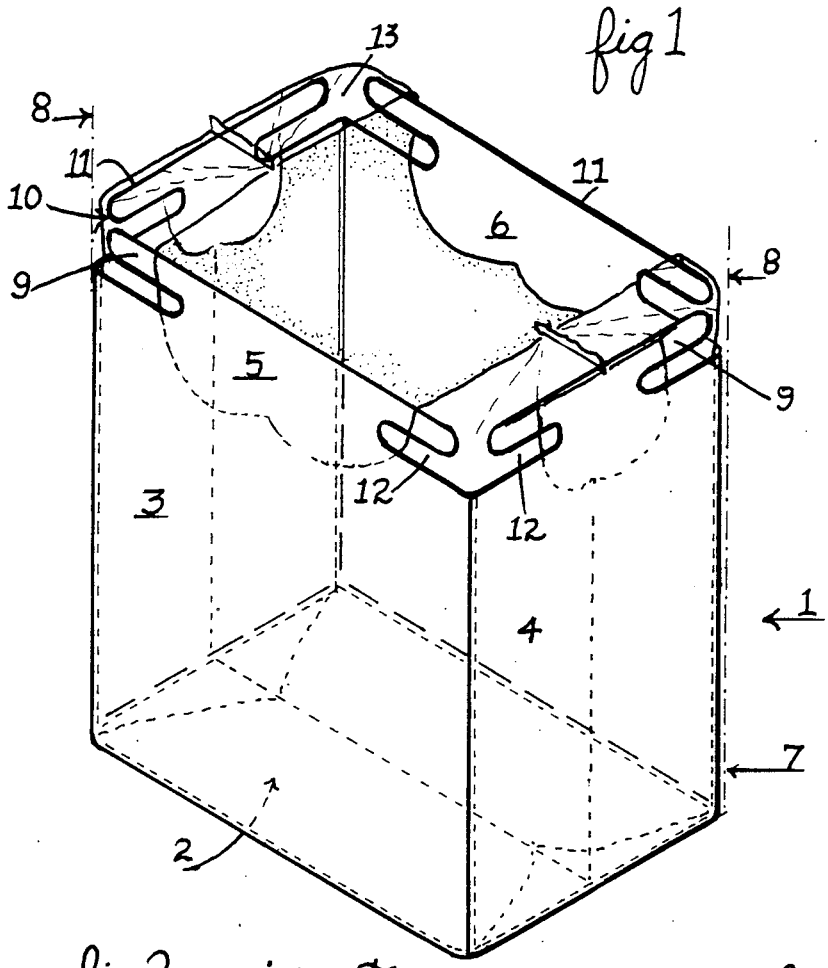
FIG. 1 is a perspective view of a container, according to the invention, shown supporting a plastic grocery bag.

The preferred embodiment of this invention, illustrated in FIG. 1 comprises a container 1 having a bottom 2, a front side wall 3, a right side wall 4, a left side wall 5, and a back side wall 6. The container is sized to fit a specific bag, therefore the width of the front 3, back 6, right 4, and left 5 container walls corresponds to bag walls 31, 32, 34, and 33, respectively. At the top of the container walls are four pairs of horizontally extending support members 9. Each support member points away from its paired support member, and in the direction of the closest vertical corner 7, or extension 8 of the nearest vertical corner. Each horizontal support member 9 is aligned parallel to and within the plane of the wall upon which it is located. All support members are of equal height, and have accompanying openings 12. Two support members 9 point towards an extension of each vertical corner 8, and the accompanying openings 12 abut the same vertical corner extension 8, forming a right angled opening that has a neck like space 13 between the tips 10 of two support members 9.

A plastic bag 30 is placed in the container and a support member 9 is inserted from the direction of an open mouth notch 43, or from the direction of a closed handle notch 44, into a front inside pleat 36 or into a back inside pleat 40 of a bag handle 45 until the tip 10 of the support member reaches a front outside fold 35*a* or a back outside fold 39*a* of the bag at a spot 48 approximately half way down the bag's handle. As the tip 10 of a support member is inserted into a handle's inside pleat 36 or 40, one side 46 or 47 of a bag handle 45 will automaticly slip into the opening 12 below the support member. This process is repeated until all eight support members are inserted into the pleats of a bag's handles, and the handles 45 cover the rounded rims 11 or the right and left side walls and the rounded tips 10 of the support members 9. A bag is thusly held open and suspended from within its pleated bag handles by said container's said support members. This positioning of said support members secures the top of a bag, facilitates the filling of a plastic bag to its maximum capacity and provides for ease of compacting a bag's contents. While a bag itself is supported from within its handles, the weight of a bag's contents is supported by the walls and the bottom of said container. A neater and undistorted bag handle configuration results from inserting all eight support members, however, a bag will be supported in an upright, four cornered configuration by any four support members, so long as at least one support member is inserted at each corner of an open bag.

A support member 9 has dimensions relative to a specific bag 30. Said support member must be long enough horizontally to reach within the pleat 36, 40 and small enough vertically to pass through and around the open, mouth notch 43 and the closed, handle notch 44 of a bag 30. The opening 12 situated directly below each support member 9, must likewise have a horizontal and vertical measurement capable of receiving the outside section 47 of a bag handle or the inside section 46 of a bag handle.

A plastic bag's handle that are draped over said support members and over the rim of the right and left side walls of said container will be hidden from view by the addition of outwardly and upwardly extending wall extensions, hereinafter referred to as frame extensions, as in the preferred embodiments of FIGS. 4 and 5.

The preferred embodiment of this invention, illustrated in FIG. 4 comprises a container 14 having an outwardly, upwardly extending frame extension 15 and a rim 16 with curved flange reinforcing. Four pairs of support members 17 and accompanying openings 18 are recessed below and within said frame extension 15, but remain parallel to and in alignment with the plane of the side wall upon which said support member is situated, exclusive of said frame extension.

Illustrated in FIG. 5 the preferred embodiment of this invention comprises a container 19 wherein said container walls 20 are tapered so that the lower perimeter is smaller, enabling said container to be stacked one within another. Directly below two opposing pairs of support member 23 and said support member's accompanying openings 24, said container walls 19 expand horizontally in an outward direction, then upward to a location above the upper rim 25 of said support members, forming the frame extension 21, said frame extension being reinforced at its upper rim 22. Said suport members being parallel to and in alignment with the plane of the side wall upon which said support member is situated, exclusive of said frame extension.

The preferred embodiment of this invention illustrated in FIG. 6 comprises a container 26 having two opposing pair of support members 27 rounded to inhibit puncture of a plastic bag mounted thereon. Each support member 27 has, within the planar surface upon which said support member is located, and accompanying opening 28. Said opening being located directly below and adjacent to said support member, and directly adjacent to a corner location.

FIG. 7 an enlarged perspective view of an upper corner of the container, according to the invention, depicts the placement of said support members 9 within the inside of a plastic bag handle 45, the tips of said support members touching a bag handle at the general location 48 where a bag's outside fold, having a 0° angle, makes the transition to an open corner having a 90° angle. Upon insertion of the support members, sides 46 and 47 of a bag handle 45, automatically slide into the openings 12 under said support members.

Although in the preferred form the container of this invention is made of a plastic or resin material, it is contemplated that said container can also be made of wood or metal.

It will be appreciated to those skilled in the art that modifications and variations made to accommodate aesthetic preferences, various manufacturing processes, or the differences in the structural properties of various materials, may be made on the preferred embodiment therein without departing from the function, intention, spirit or scope of this invention as described by the following claims.

What is claimed is:

1. A container for holding in a fully opened, four cornered configuration, the body and mouth of a plastic bag having upwardly extending and pleated handles, while supporting, on the sides and the bottom, a plastic bag in an upright position: said container comprising:

a. a horizontal planar surface forming the bottom of said container, and a plurality of side walls formed from substantially vertical planar surfaces attached to said bottom and forming a rim along their upper extremities;

b. a plurality of pairs of support members integrally formed with said side walls, such support members being positioned one pair connected to one said vertical planar wall; each support member having a horizontally extending projection extending oppositely from its paired support member, and pointing toward respective corner locations defined between adjacent pairs of side walls; each pair of horizontal support members being generally parallel to and in alignment with the plane of respective said side wall upon which each said pair of support members is mounted; each support member being capable of insertion within an inner pleat of a bag handle at a location where an outside fold of a plastic bag makes the transition from an open 90° angled configuration sufficient to form a four cornered fully opened bag to a 0° angled and closed configuration of a folded bag handle; all of said support members being generally equal to one another in height; and c. a plurality of openings, equal to the number of said support members, each said opening being located directly below and adjacent to respective said support member, each said opening being adjacent to respective corner location.

2. The container specified in claim 1, wherein the horizontal measurement, from tip to tip, for one said pair of support members is equal to the distance from a corner location to another corner location of a top horizontal dimension of one said vertical planar wall, upon which said pair of support members is attached, less a measurement ranging between 1 millimeter and 40 millimeters, the measurement from an upper edge of each said support member to said bottom of said container, is equal to a plastic bag's vertical measurement in a fully opened four cornered configuration, the vertical measurement from an upper edge of said support member to a lower edge of said support member shall be sufficiently small to allow insertion, through a respective bag opening, within a bag handle's inner pleat, and shall be sufficiently large to sustain said support member's horizontal projection.

3. The container specifed in claim 1, wherein the minimum horizontal measurement of an opening beneath said support member and within a plane of said side wall is generally equal to 66% of the measurement of the length of a seam at a top of an upwardly extending folded handle of a plastic bag for which said container is sized and the maximum horizontal measurement of said opening being generally 45% of the corner to corner measurement between opposite said side walls adjacent to said side wall in which said opening is located, the minimum vertical measurement of said opening being substantially one millimeter and the maximum vertical measurement of said opening being the distance between said support member and said container bottom.

4. The container specified in claim 1, wherein said support members are rounded at their free ends to inhibit puncture of a plastic bag mounted thereon.

5. The container specified in claim 1, wherein said rim of said container is rounded to inhibit puncture of a plastic bag mounted thereon.

6. The container specified in claim 1, further conprising an upwardly extending frame extension connected to said container below said openings and said support members, and extending outwardly from said side walls, said support members being situated and recessed below and within the confines of said frame extension.

7. The container of claim 1, wherein said container walls are tapered so that the lower perimeter adjacent said bottom is smaller that the upper perimeter adjacent said rim, enabling said container to be nested or stacked one within another.

8. The container specified in claim 1, wherein each side wall is connected to its ajoining said side wall at a vertical corner location.

* * * * *